United States Patent [19]

Thatcher

[11] Patent Number: 4,584,782

[45] Date of Patent: Apr. 29, 1986

[54] SPORT SANDAL CONSTRUCTION

[76] Inventor: Mark Thatcher, Box 968, Flagstaff, Ariz. 86002

[21] Appl. No.: 560,569

[22] Filed: Dec. 12, 1983

[51] Int. Cl.[4] ..... A43B 3/12

[52] U.S. Cl. ..... 36/11.5; 2/DIG. 6

[58] Field of Search ..... 36/11.5, 138, 8.1, 50; 2/DIG. 6

[56] References Cited

U.S. PATENT DOCUMENTS

| | | | |
|---|---|---|---|
| 2,642,677 | 6/1953 | Yates | 36/11.5 |
| 4,200,997 | 5/1980 | Scheinhaus | 36/11.5 |
| 4,226,031 | 10/1980 | Wong | 36/11.5 |

FOREIGN PATENT DOCUMENTS

| | | | |
|---|---|---|---|
| 1947245 | 3/1971 | Fed. Rep. of Germany | 36/11.5 |

OTHER PUBLICATIONS

"Construction of the Quickie Sandal", Alimed, Boston, Mass., Dec. 1972.

*Primary Examiner*—Werner H. Schroeder
*Assistant Examiner*—T. Graveline
*Attorney, Agent, or Firm*—Joseph L. Strabala

[57] ABSTRACT

Novel sandal construction including a convertible heel harness to minimize foot slippage in its closed rearward position, and to become a part of a frontal ankle strap in its alternate, forward portion. Thus, the sandal may be slipped into and worn with an open back, or may be placed upon the foot with the harness engaging the heel.

3 Claims, 4 Drawing Figures

SPORT SANDAL CONSTRUCTION

BACKGROUND OF THE INVENTION

Sandals and thongs having various forms of straps for securing the device, to the foot of the wearer are well known in the prior art. Some of these prior art devices have straps extending over only the forward part of the foot and with no heel support so that the foot can be readily slipped into and out thereof, while others have, in addition to such forward straps, a strap or sling extending behind the rear portion of the foot and engaging the heel of the wearer. The former type, while it has the feature of being easily slipped on and off the foot of the wearer, which is desirable in many instances, has a distinct disadvantage in that it fits somewhat loosely on the foot and permits slippage and heel slapping during normal walking. As a result, the foot of the wearer may be irritated and the device may even be accidentally lost from the foot. The latter type, generally having a loose-fitting sling or strap surrounding the heel of the wearer, reduces but does not eliminate the slippage and heel slapping, and is not readily slipped on and off the foot should it be desirable to have the step-in step-out convenience for use such as in shower or beach wear. One prior art device combines desirable features of both types by utilizing a convertable heel sling. This device reduces slippage and heel slap but the reduction is largely limited by the discomfort of tightening the sling and thereby forcing the foot of the wearer into the web attachment between the wearers' toes.

SUMMARY OF THE INVENTION

The novel footwear according to the invention combines the desirable features of all three types by including a convertible strap device adapted to function as a heel harness which minimizes slippage and eliminates heel slapping in its closed rearward position, and to become a part of the frontal ankle strap in its alternate, forward position. Thus, the footwear may, at the discretion of the user, be slipped into and worn with an open back as a modified so-called thong, or may be placed upon the foot with the harness engaging the heel in the manner of a recreational sandal surpassing in support the prior art thongs described previously.

It is therefore an object of the present invention to provide footwear having a convertible ankle strap device which in one position allows the foot to be readily slipped into and out of the footwear and in another position minimizes slippage and eliminates heel slapping of the footwear during running walking.

Another object of the invention is to provide footwear having a dual function wherein the footwear can be worn either with an open back or with a heel engaging harness to suit a particular occasion at the descretion of the wearer.

Another object of the invention is to provide, in an article of footwear, a convertible ankle strap device which in one position creates an open back in the footwear and in another position causes the foot of the wearer to be engaged in a strong clamping action so as to maintain the footwear in position.

Another object of the present invention is to provide footwear that minimizes weight and fastening time while at the same time maximizing foot sole protection and recreational capability particularly in and about water environments.

Other objects and advantages of the invention will become more apparent during the course of the following description when taken in connection with the accompanying drawings.

BRIEF DESCRIPTIONS OF THE DRAWINGS

In the drawings, wherein like numerals are employed to designate like parts throughout the same:

DETAILED DESCRIPTION OF THE INVENTION

Figure 1:
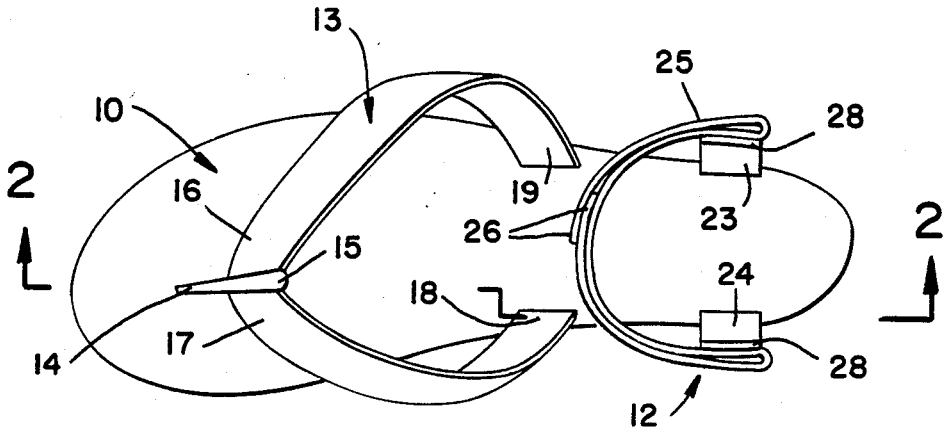
FIG. 1 is a plan view of a sandal constructed in accordance with the present invention, showing the convertible heel harness in the storage position.
Figure 2:
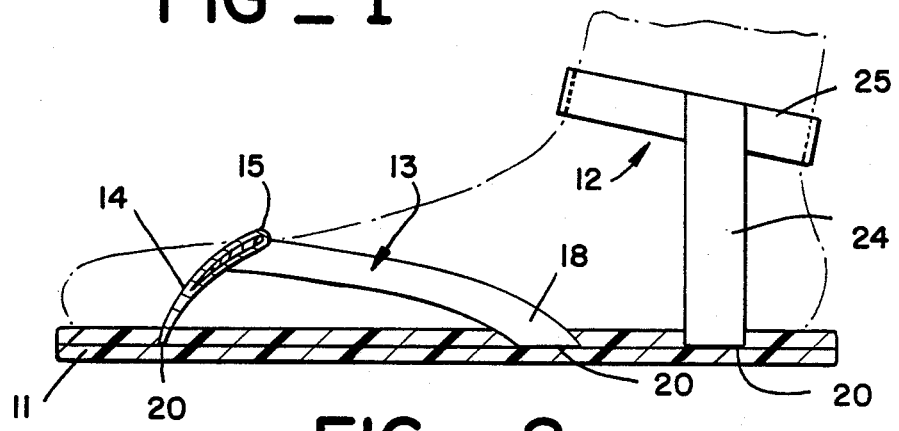
FIG. 2 is a side elevational view, partially in section along line 2—2 of FIG. 1, and with parts broken away showing the sandal on the foot of a wearer with the harness in the heel engaging position.

Turning now to the drawing and in particular to FIGS. 1 and 2 thereof, one form of footwear constructed according to the invention is shown generally at 10. The footwear includes a sole 11 adapted to support the foot of a wearer in the manner indicated in broken lines in FIG. 2, and two strap assemblies 12 and 13 affixed to the sole for maintaining the device upon the foot. It will be readily appreciated that the sole 11 may be formed of any of a number of suitable materials commonly employed for a similar purpose in the construction of footwear. As will be hereinafter more fully described, the strap assemblies are generally, although not necessarily, formed of a nylon webbing material.

The strap assembly 13 comprises a thin vertical web 14 secured to the sole in the forward medial portion thereof, the web being oriented with its narrow dimension extending longitudinally of the sole so as to be comfortably received between adjacent toes of the wearer. At its upper end 15, the vertical web branches into a pair of flat, oppositely disposed side straps 16 and 17 adapted to diverge over the top of the foot and down along the sides thereof. The rear extremities 18 and 19 of the side straps 16 and 17, respectively, are secured to the sole along the rear edge portions thereof. At their junction with the upper end 15 of the vertical web 14, the side straps 16 and 17 lie substantially horizontal along the upper surface of the foot. As they extend outwardly and rearwardly, the straps twist along their longitudinal axis to follow the surface of the foot so that in their intermediate portion they are substantially vertical. The straps continue to twist about their longitudinal axis until at the rear extremities 18 and 19, respectively, they have twisted approximately 180° to lie in an inverted position beneath the foot at their juncture with the sole. By thus twisting through approximately 180°, the broad interior surfaces of the straps will continually lie against the surface of the wearer's foot to assure a comfortable fit.

A short distance rearwardly from the extremities 18 and 19 and secured to the sole are straps 23 and 24 which connect the rearward portion of the sole to the convertible ankle strap 25 and together comprise the so-called heel harness 12. The entire strap assembly, including the convertible strap 25, is preferably formed of a non resiliant but flexible material such as nylon, for example, so that the convertible strap can easily be folded 180° upon itself and fastened into the so-called storage position shown in FIG. 1. The wearer will thus be enabled to slip his foot between side straps 23 and 24 and beneath ankle strap 25 with ease.

It will be appreciated that the strap assemblies 12 and 13 may be secured to the sole in any suitable manner, such as by vulcanizing, stitching, or even by being formed integrally with the sole. One preferred means for securing the straps is shown in FIGS. 1 and 2, wherein the straps are bonded by adhesives to surfaces within layers of the sole 20.

It will be appreciated that the convertible ankle strap 25 may be fastened in the open storage and closed harness positions by any suitable manner, such as by tying or buckling. One preferred means of fastening the convertible ankle strap is shown in FIGS. 1 and 2; wherein, hook and loop fastening fabrics are sewn to the extremities 26 to fasten the ankle strap in both the open storage (FIG. 1) and closed heel harness (FIG. 2) positions. It will also be appreciated that strap connecting junctions 15 and 28 are preferrably stitched together but may be connected in any suitable manner.

With the convertible strap assuming the storage position shown in FIG. 1, when a prospective wearer desires to use the device as an open-backed sandal he merely slips his toes forwardly between heel straps 23 and 24, beneath convertible ankle strap 25 fastened in the storage position and beneath the side straps 16 and 17 until the vertical web 14 is in position between the large toe and second toe as in conventional footwear of this type. The convertible strap then lies across the frontal ankle of the wearer. When it is desired to wear the footwear with the convertible strap in the closed heel harness position of FIG. 2, the strap is unfastened from its frontal ankle storage position at extremities 26 and the toes are slipped forwardly between heel straps 23 and 24, beneath open ankle strap and under the side straps 16 and 17 until the vertical web 14 is in position between the toes. The convertible strap 25 is then pulled around the ankle and fastened behind the ankle to desired tightness. The ankle strap is of such length that it may be comfortably and adequately fastened in the frontal storage and engaged heel harness positions.

Figure 3:
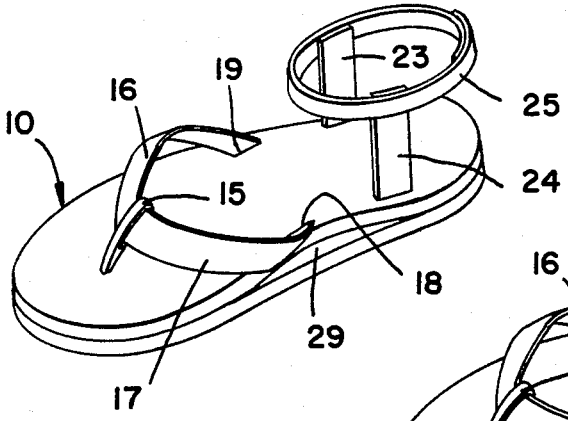
FIG. 3 is a perspective view of an alternate embodiment of the invention.

In FIG. 3 there is shown an alternate embodiment wherein the inventive concept is applied to sole having an arch 29.

Figure 4:
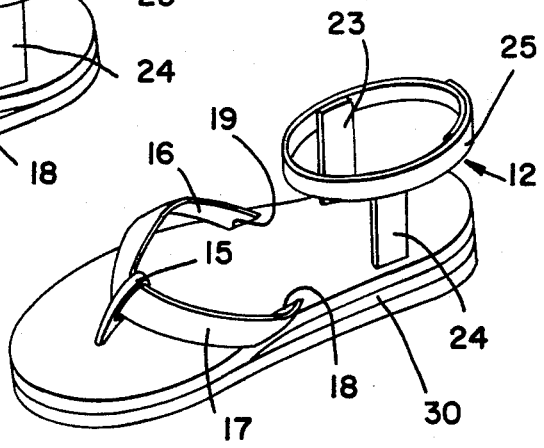
FIG. 4 is a perspective view of still another embodiment of the invention.

Still another embodiment is shown in FIG. 4 wherein the inventive concept is applied to sole having an elevated heel 30.

It is to be understood that the forms of the invention herewith shown and described are to be taken as illustrative embodiments only of the same, and that various changes in the shape, size and arrangement of parts may be resorted to without departing from the spirit of the invention.

The invention described above can also be understood as having a heel harness with two spaced apart straps 23 and 24 at the heel end of the sandal 10 which straps extend upwardly approximately to the anklebone of the wearer's foot. Junctioned at the top ends 28 of these two upright support straps is a horizontal strap 25 which forms a semi-circular loop between these upright support straps just forward of the heel end of the sandal. As can be seen in the drawings, this semi-circular loop strikes the wearer at the ankle joint. Thus, when the distal or free ends 26 of the horizontal strap 25 are secured behind the ankle of a wearer, a small circular loop surrounds the upper portion of the ankle. Because this loop surrounds the ankle at its smallest diameter, i.e., the joint of the ankle with the leg, it secures the harness in a manner that the sandal cannot be dislodged from the wearer's foot as the portion of the foot below the strap has a greater circumference than that of the loop of the strap. It is this small loop of non-stretchable strap at the particular location which presents the current sandal from being dislodged when the wearer's foot even when the wearer is walking through thick mud. In fact, in river rafting the Applicant's sandal has become the preferred footwear, almost without exception, due to its unique characteristics.

The front end of the sandal is retained on the forward part of the foot by a "Y" shaped strap assembly having a web 14 anchored centrally in the toe end of the platform sole 11. This web at its upper end 15 diverges into two flat footstraps or side straps 16 and 17 that are respectively anchored along opposite sides of the sole at anchor points 18 and 19 where they are fixedly secured.

These two assemblies on the platform sole provide a full retention capability for a wearer of the unique sandal even in thick mud, as well as while the wearer is engaged in vigorous sports activities, such as running.

As can be seen in the drawings the platform sole in the area of the arch can be elevated by integral insert.

I claim:

1. A sport sandal of the thong type with full retention capabilities comprising:

a platform sole means having a general peripheral configuration corresponding to that of a human foot and having a toe end and a heel end;

a frontal "Y" shaped strap assembly having a web anchored centrally in the toe end of said platform sole means, said web diverging into two flat footstraps above said platform sole means with one of said footstraps disposed along the longitudinal side of said platform sole means and the other footstrap disposed along the opposite side of said platform sole means, each footstrap extending to a separate anchor point adjacent to the heel end thereof on its side of said platform sole means with each of said straps fixedly secured to said platform sole means at its respective anchor point, an ankle harness having two upright support straps, one of said upright support straps having an end fixedly anchored in said platform sole means adjacent to its heel end along one side thereof and the other one of said upright support straps having an end fixedly anchored in said platform sole means adjacent to its heel end along the opposite side thereof, each of said upright support straps having a height above the sole means sufficient to place the top end thereof proximate to the ankle bone of a wearer when the sandal is worn, and a horizontal strap with two free ends forming a semi-circular loop between the top ends of said upright support straps forward of the heel end of said platform sole means with said semi-circular loop joined with the top ends of said support straps and means on said free ends of said horizontal strap for connecting said free ends of said horizontal strap around the wearer's ankle when said sandal is worn.

2. The support sandal defined in claim 1 wherein the semicircular loop contains means for temporary retention of the free ends of said horizontal strap when said free ends are juxtaposed against said horizontal strap so the wearer may wear the sandal without securing the horizontal strap behind the wearer's ankle.

3. The sandal defined in claim 1 wherein the platform sole means includes a to elevate the top portion of said platform sole means in the area of the arch of the wearer and a second filler in the heel end of said platform sole means to elevate the top thereof beneath the heel of a wearer of said sandal.

* * * * *